United States Patent [19]

Yurkovic

[11] Patent Number: 5,067,723

[45] Date of Patent: Nov. 26, 1991

[54] HEAD MASK TABLETOP ACTION GAME

[75] Inventor: Paula M. Yurkovic, Chicago, Ill.

[73] Assignee: Irwin Toy Ltd., Toronto, Canada

[21] Appl. No.: 653,038

[22] Filed: Feb. 8, 1991

[51] Int. Cl.[5] ..... A63F 3/00; A63H 33/00

[52] U.S. Cl. ..... 273/249; 273/276; 273/DIG. 17; 273/DIG. 30; 446/27

[58] Field of Search ..... 273/249–254, 273/256, 258, 276, DIG. 17, DIG. 30; 446/27

[56] References Cited

U.S. PATENT DOCUMENTS

| | | | |
|---|---|---|---|
| 3,468,540 | 9/1969 | Mulligan | 273/276 |
| 3,817,531 | 6/1974 | King et al. | 273/243 |
| 4,113,259 | 9/1978 | Sands | 273/249 |
| 4,813,680 | 3/1989 | Rudell et al. | 273/249 |

OTHER PUBLICATIONS

"Greenie Beanie", Cossman and Levine, Inc. Advertisement, 3/10/1965.

*Primary Examiner*—Benjamin Layno

[57] ABSTRACT

A tabletop action game to be played by two, three or four players. In one version, each player wears a head mask which carries four locks of simulated hair which are each removably fastened to the head mask. In another version of the game, the locks of simulated hair are removably fastened to a replica of a head designated for each player on a game board. Each player has a marker which is moved along a path on a game board with the movement decided by the roll of a die. Instructions or indicia on the spaces forming the path tell the players to remove locks of simulated hair from the head masks or replicas thereof of other players or to transfer locks of simulated hair to the other players. The winning player either collects locks of simulated hair of all the different colors involved or looses all of the locks of simulated hair except the single lock of simulated gray hair.

2 Claims, 2 Drawing Sheets

HEAD MASK TABLETOP ACTION GAME

BACKGROUND AND SUMMARY OF THE INVENTION

This invention is directed to a tabletop board game which involves physical interaction between the players. Most board games are sedentary in their play and thus appeal more to adults than to children. In contrast, most games involving physical interaction between the players are not well suited to being played indoors and, especially, are not well suited to play around a table in a living environment. Accordingly, an object of this invention is a tabletop board game which requires the players to physically interact with each other during the course of playing the game.

Another object of this invention is a board game which is particularly attracted to children because it involves limited physical interaction between the players while minimizing the risk of physical injury due to this physical interaction.

Another object of this invention is a game in which the physical interaction between the players is determined by the players' movements along a path of a game board, which movements are in turn controlled by chance based on the roll of a die.

Another object of this invention is a board game in which any physical interaction with an opponent is directed to a proxy image representing the opponent and not to the opponent himself, with the proxy image being depicted on a playing board.

Other objects may be found in the following specification, claims and drawings.

BRIEF DESCRIPTION OF THE DRAWINGS

The invention is illustrated more or less diagrammatically in the following drawings wherein.

DESCRIPTION OF THE PREFERRED EMBODIMENTS

Figure 1:
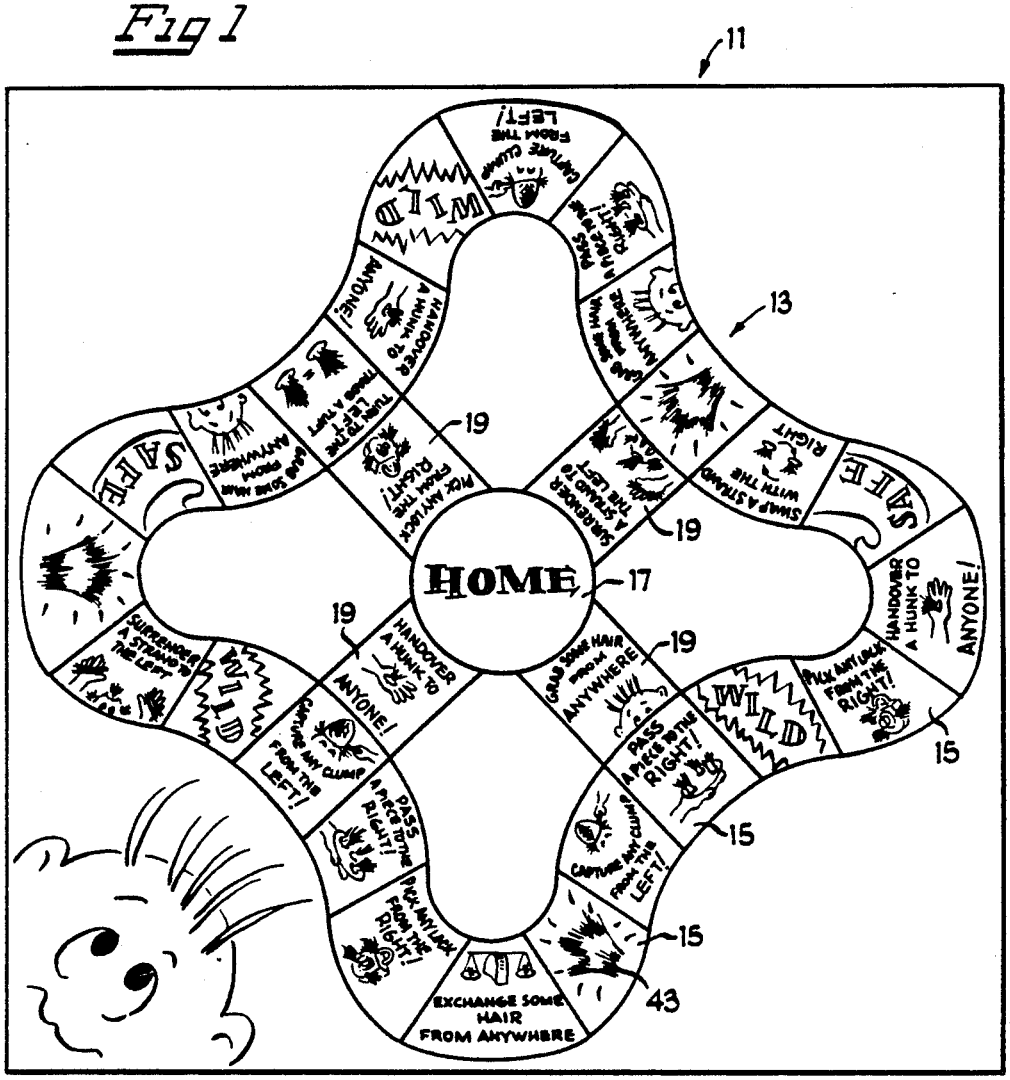
FIG. 1 is a top plan view of a playing board for one embodiment of the game of my invention.
Figure 2:
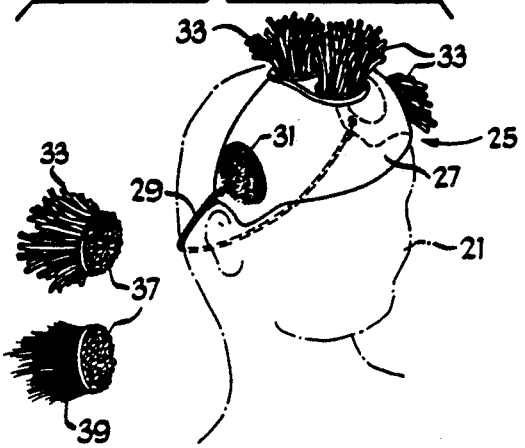
FIG. 2 is an exploded perspective view of a player, shown in phantom line, wearing a head mask which may be used in playing the board game shown in the embodiment of FIG. 1, with a lock of the simulated hair shown separated from the head mask and an additional lock of gray hair.
Figure 3:
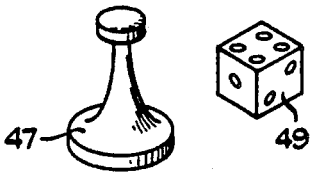
FIG. 3 is a perspective view of a marker and die used in playing the embodiments of the board game of my invention.

A first embodiment of the game of my invention, the embodiment which involves limited physical interaction between the players, is shown in FIGS. 1-3 of the drawings. A game board or playing board 11 used with this embodiment of my game is shown in FIG. 1 of the drawings. This game board may be made in a conventional manner of a hard piece of cardboard or paper which may, or may not, fold in the center, depending upon its size, with printing to indicate the decorative and functional features of the game applied to the upper surface of the game board. The printing depicts a path 13 formed of a series of spaces 15. The path 13 forms a closed loop and surrounds a centrally located circular home space 17. The circular home space 17 is connected to the path 13 by transition spaces 19 forming a crossover between the path and the circular home space.

As shown in FIG. 2, each player 21 is provided with a head mask 25 which is formed of a piece of fabric 27 or other suitable flexible material which is supported on a player's forehead by a stretch band 29. Attached to the piece of fabric 27 are four fastener bases 31, each of which receives a lock 33 of simulated hair. Preferably, yarn is used as the simulated hair. The fastener bases are made of a large number of miniature plastic hooks while each of the locks 33 has a corresponding base portion 37 formed of miniature plastic loops, which together form a hook and loop fastener mechanism which is sold under the trademark VELCRO. It should be understood and appreciated that other types of fastening means may be utilized to connect the locks 33 of simulated hair to the fabric 27 of the head mask, but the hook and loop fastener mechanisms have been found most satisfactory for this purpose.

In the embodiment of FIGS. 1-3 of the drawings, the fastener bases 31 are arranged on the piece of fabric 27 so that two are located together at the top of a player's forehead and one at each side of the forehead. But, it should be understood that this arrangement may be varied. Additionally, the locks 33 of simulated hair are provided in four different colors corresponding to the colors of natural human hair, for example, red, blond, brown and black, but of course other colors may be used if desired. Additionally, there is an additional lock 39 of simulated gray hair shown in FIG. 2 which also has connector loops 37 on its bottom and which can attach to a fastener base 31 on a player's head mask as a substitute for one of the locks 33.

As can be seen in FIG. 1 of the drawings, the spaces 15 have printing or indicia applied to them which provide either instructions to or penalties for the player landing on the particular space. For example, the spaces 15 which bear an indicia 43 of gray hair require the player landing thereon to pick up the lock 39 of simulated gray hair either from the playing board or from another player who may be wearing it on his or her head mask. Other indicia printed on spaces 15 indicates that a space is a safe space. When a player is on a safe space, no other player can give or take a lock of simulated hair from that player's head mask. Other spaces 15 bear the word "wild" which permits a player who lands on that square to move to any other square on the board. The types of instructions or penalties which can be indicated on the spaces 15 are limited only by the nature of the game and, thus, these examples should not be considered as limiting.

Each player has a distinctive marker 47 shown in FIG. 3 of the drawings, which marker is of a convenient size to fit on one of the spaces 15. The colors of the markers may correspond to the red, blond, brown and black colors used for the locks of simulated hair or other distinctive colors may be used. A die 49 is used to indicate the number of spaces a player may move during his or her turn.

The game of the embodiment shown in FIGS. 1-3 of the drawings is played in the following manner. Each player chooses a marker 47 of one of the four available colors and a head mask 25 is placed on the forehead of each player, with the head mask bearing four locks 33 of simulated hair, all of the same color, which color may also match that of the player's marker 47.

The players take turns rolling the die 49 and move from space to space 15. When a player lands on a space 15 bearing the "safe" indicia, no other player can give or take a lock 33 of simulated hair from that player's head mask 25. When a player lands on a space 15 marked with the indicia "wild", that player can move to any other space on the game board 11 and follow the instructions indicated on that space. If a player lands on a space 15 that bears the indicia 43 of a lock 39 of gray hair, the player must take the simulated lock 39 of gray hair and wear it on his or her head mask until someone else lands on that square or another player takes the lock of gray hair. When a player accumulates at least one lock 33 of each color of simulated hair without the lock 39 of gray hair, the player may then attempt to follow the path 13 across one of the transition spaces 19 to the circular home space 17 and become the winner of the game.

Figure 4:
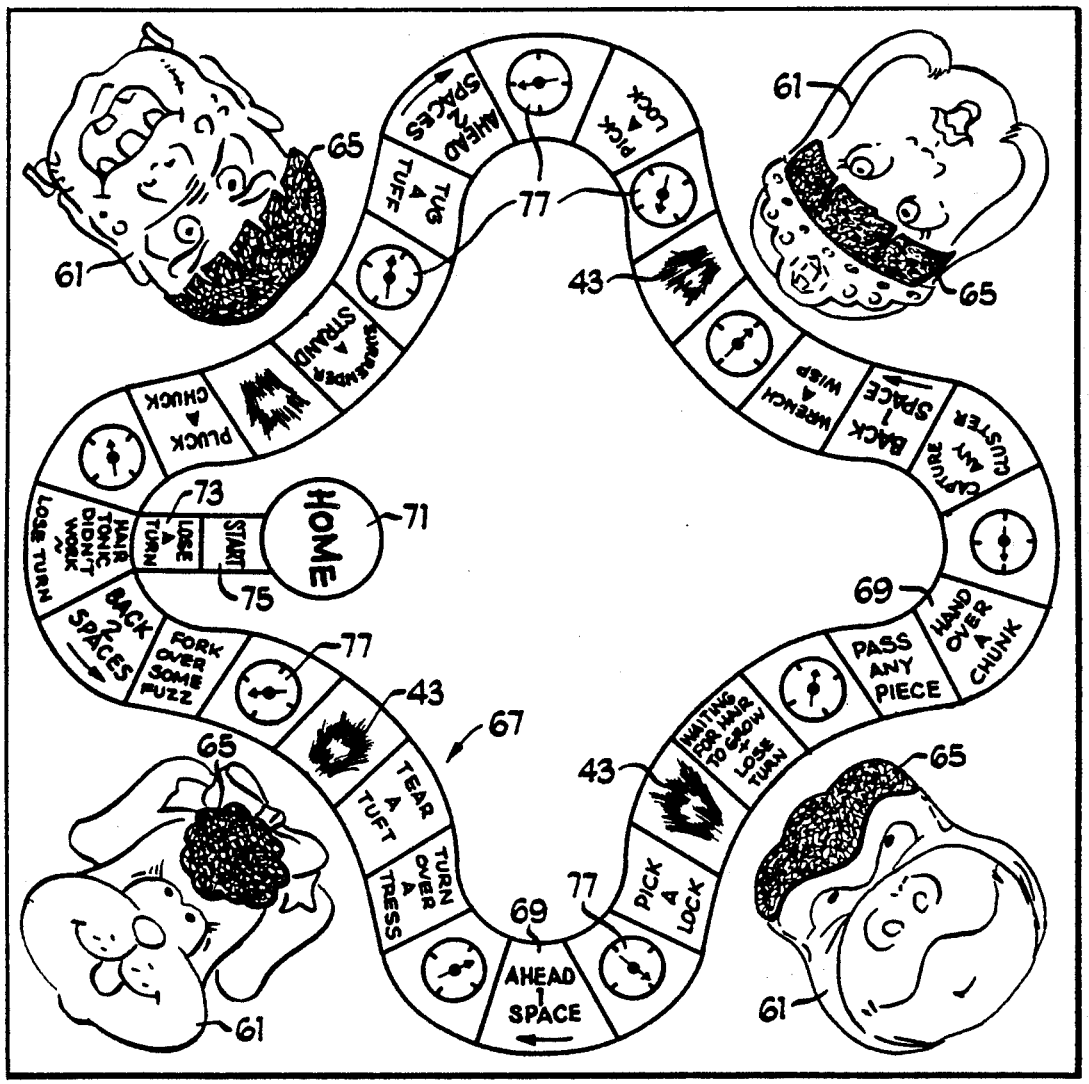
FIG. 4 is a top plan view of a playing board for a second embodiment of the game of my invention.
Figure 5:
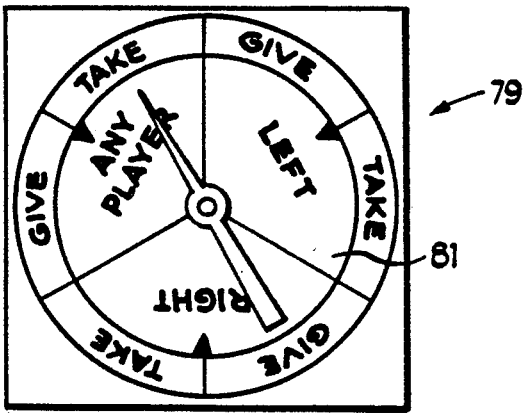
FIG. 5 is a top plan view of a spinning pointer selector used with the embodiment of the game board shown in FIG. 4.

A second embodiment of my invention is shown in FIGS. 4 and 5 of the drawings and uses the marker 47 and die 49 shown in FIG. 3. This embodiment of my invention directs the physical interaction of the players to replicas 61 of heads which are printed in the corners of a game board 63 rather than to head masks on the players. The game board 63 is similar in construction to the game board 11 previously described. In this embodiment of my game, the players remove and attach the locks 33 of simulated hair to the fastener bases 65 which are mounted on the game board 63 on what would be the foreheads of the replicas 61 of heads. The path 67 consists of a series of spaces 69 which form a closed loop. A circular home space 71 is located inside the closed loop but is accessible from only one direction along spaces 73 and 75. Space 75 is indicated by printed indicia as the "start" where each player must start with his or her distinctive marker 47. A player uses the die 49 to determine the number of spaces to be moved in each turn and the indicia on the spaces is similar to that previously described for game board 11, except there are indicia 77 which depict a spinnable pointer. A spinnable pointer selector 79, shown in FIG. 5 of the drawings, has various sectors 81 printed thereon with the sectors containing different instructions for the players. When the player's marker 47 lands on a space 77 having an indicia of a pointer thereon, the player must spin the pointer selector 79 and follow the instructions printed on the sector 81 on which the pointer comes to rest.

In playing the game shown in the second embodiment of my invention, each player selects a marker 47 and corresponding simulated locks of hair 33. Each player places these locks of hair on his or her own fastener bases 65 which are formed as part of their replica 61 of a head. The players in turn roll the die 49 and move their respective markers 47 along the path 67 in accordance with the number of spaces indicated by the die. If a player lands on a space 69 having an indicia 77 of a pointer applied thereto, the player must spin the pointer 79 and follow the instructions in the sector 81 on which the pointer stops and give up or accept simulated locks of hair 33 in accordance with the instructions on the pointer. If a player lands on a space having an indicia 43 of gray hair, the player must take the lock 39 of simulated gray hair.

Players proceed along the path 67 until a player collects four different colors of locks 33 of simulated hair and is able to proceed to the home circle 71 without the lock 39 of gray hair. If a player reaches home space 71 without four different colored locks 33 of hair or has the gray hair lock 39, the player must go around the path 67 one more time. In this embodiment of the invention, the first player to make it to the home space 71 without the simulated lock 39 of gray hair is the winner.

I claim:

1. A tabletop action game for three or more players, including:

a head mask to be worn by each player, each head mask having easily releasable fastening means for attaching locks of hair to the helmet, a plurality of locks of hair being attached to each head mask, with each lock being of a different specified color of a selected limited set of colors, a playing board having a path indicated thereon, said path having a series of spaces starting at a beginning and continuing to an end, a distinctive marker for each player which marker will fit on a space of the series of spaces forming said path, means to randomly indicate, within a range, the number of spaces a player must move his marker during his playing turn, and indicia on at least some of said squares in said path to indicate the player whose marker lands on one of said squares is entitled to remove a lock of hair from the head mask of another player and attach it by means of the easily releasable fastening means to his own head mask.

2. The tabletop action game of claim 1 in which each marker is distinctive because of its unique color and the color of the locks of hair attached to the head mask of each player match the color of the player's marker.

* * * * *